US009228269B2

(12) United States Patent
Okada et al.

(10) Patent No.: US 9,228,269 B2
(45) Date of Patent: Jan. 5, 2016

(54) TIN ALLOY PLATING SOLUTION

(71) Applicant: Rohm and Haas Electronic Materials LLC, Marlborough, MA (US)

(72) Inventors: Hiroki Okada, Niigata (JP); Shenghua Li, Niigata (JP); Makoto Kondo, Saitama (JP)

(73) Assignee: Rohm and Haas Electronic Materials LLC

( * ) Notice: Subject to any disclaimer, the term of this patent is extended or adjusted under 35 U.S.C. 154(b) by 0 days.

(21) Appl. No.: 14/201,667

(22) Filed: Mar. 7, 2014

(65) Prior Publication Data

US 2014/0251818 A1 Sep. 11, 2014

(30) Foreign Application Priority Data

Mar. 7, 2013 (JP) ..... 2013-045207

(51) Int. Cl.
*C25D 3/56* (2006.01)
*C25D 3/60* (2006.01)

(52) U.S. Cl.
CPC ..... *C25D 3/60* (2013.01)

(58) Field of Classification Search
CPC ..... C25D 3/32; C25D 3/56; C25D 3/60; C25D 3/64
USPC ..... 205/252, 253, 238
See application file for complete search history.

(56) References Cited

U.S. PATENT DOCUMENTS

| | | | | |
|---|---|---|---|---|
| 3,940,319 | A * | 2/1976 | Pollack | 205/253 |
| 4,021,316 | A | 5/1977 | Fueki et al. | |
| 4,161,432 | A | 7/1979 | Barclay et al. | |
| 4,532,186 | A * | 7/1985 | Shibagaki et al. | 428/457 |
| 2005/0077186 | A1* | 4/2005 | Hansen et al. | 205/252 |
| 2012/0138471 | A1* | 6/2012 | Mayer et al. | 205/170 |

FOREIGN PATENT DOCUMENTS

| | | | |
|---|---|---|---|
| CN | 1804142 | A | 7/2006 |
| GB | 680937 | A * | 10/1952 |
| JP | 55161088 | A | 12/1980 |
| JP | 09170094 | A | 6/1997 |
| JP | 09302498 | A | 11/1997 |
| JP | 2006265572 | A | 5/2006 |

OTHER PUBLICATIONS

European Search Report of corresponding European Application No. 14 158010.

* cited by examiner

*Primary Examiner* — Edna Wong
(74) *Attorney, Agent, or Firm* — John J. Piskorski

(57) ABSTRACT

A cyanide-free tin alloy plating solution having outstanding serial stability as well as a method of precipitating tin alloy plating onto an electroconductive object using the tin alloy plating solution is disclosed. The tin alloy plating solution contains tin ions and one or more additional metal ions of silver, copper, bismuth, indium, palladium, lead, zinc, or nickel, and peptides with cysteine residues.

5 Claims, No Drawings

TIN ALLOY PLATING SOLUTION

FIELD OF THE INVENTION

The present invention concerns a tin alloy plating solution, specifically, a non-cyanic tin alloy plating solution having outstanding serial stability as well as a method of depositing tin alloy plating on an electroconductive object.

BACKGROUND OF THE INVENTION

The tin alloy plating bath (solution) used to form a tin alloy plating film on electroconductive objects, for example, a tin-silver alloy plating film, readily forms salts of more noble metal ions than tin that are insoluble in plating bath and so readily deposit when the oxidation/reduction potential of metal ions other than tin ions in the bath (for example, silver ions) differs greatly. Thus, maintenance of a stable bath is known to be difficult. Consequently, plating solutions that contain cyanide have been used in the past as tin-silver alloy plating solutions. However, this bath is extremely toxic because it contains toxic cyanide, and various problems are associated with its handling.

Tin-silver alloy plating baths that contain thiourea or thiourea derivatives Japanese Kokai publication Hei-9-302498, tin-silver alloy plating baths that contain thiol compounds such as mercaptosuccinic acid Japanese Kokai publication Hei-9-170094, or tin-silver alloy plating baths that contain aliphatic sulfides or aliphatic mercaptans Japanese Kokai publication 2006-265572 have been disclosed as tin alloy plating baths that do not contain cyanide.

However, experiments by the inventors have revealed that silver in these solutions is not capable of stable, long-term dissolution. The silver precipitates immediately after preparation of the plating bath or within 24 hours following preparation of the plating bath. This so-called bath decomposition precludes the long-term, stable use of a plating bath. In addition, the ratio of tin and other metals in a tin alloy precipitate varies greatly with change in the current density during electroplating, and a stable precipitation rate has been impossible to maintain.

Consequently, the development of a tin alloy plating bath with high serial stability that does not contain cyanide has long been desired.

SUMMARY OF THE INVENTION

Accordingly, the principal objective of the present invention is to provide a tin alloy plating solution having high serial stability, little change in the co-deposition ratios of tin and alloy metals due to changes in the current density, and with essentially no cyanide content.

The results of serious examinations by the inventors revealed that a plating bath could be stably used for a prolonged period of time even if metal ions more noble than tin are present in the plating bath by incorporating peptides with cysteine residues in a plating bath, and that a plating bath with virtually no change in the co-deposition ratios of tin and metal ions relative to increase or decrease in the current density could be derived.

Specifically, the tin alloy plating solution pursuant to the present invention contains tin ions and one or more additional metal ions selected from the group consisting of silver, copper, bismuth, indium, palladium, lead, zinc, and nickel, as well as peptides with cysteine residues.

Peptides containing cysteine residues would preferably be peptides with 2 to 20 amino acid residues, and glutathione would be more preferable. Other preferable metal ions include metal ions that contain silver ions, and silver ions would be more preferable. In addition, the tin alloy plating solution preferably would be acidic.

The method of depositing the tin alloy plating pursuant to the present invention onto an electroconductive object would contain two steps; step (A) in which an electroconductive object is brought into contact with a tin alloy plating solution containing tin ions and one or more additional metal ions selected from the group consisting of silver, copper, bismuth, indium, palladium, lead, zinc, and nickel, as well as peptides with cysteine residues, and step (B) in which current is passed between electrodes and said electroconductive object.

DETAILED DESCRIPTION OF THE INVENTIONS

The terms "plating solution" and "plating bath" in the specifications are used interchangeably. ° C. refers to degrees celsius, g/L represents to grams per liter, ml/L refers to milliliters per liter, μm refers to micrometers, m/min refers to meters per minute, A/dm$^2$ and ASD refer to amperes per square decimeter.

The present invention concerns a tin alloy plating solution containing peptides that have cysteine residues. Peptides refers to compounds in which a plurality of amino acids are bound by peptide bonds (or amide bonds). Permissible amino acids include glutamic acid, glycine, cysteine, tyrosine, methionine, and aspartic acid.

Among these as well, peptides used in the present invention must have cysteine residues. Cysteine is an amino acid with the following structural formula that has an intramolecular thiol (—SH).

Formula 1

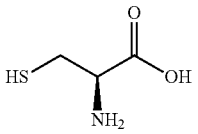

Peptides with cysteine residues preferably would be peptides that have 2 to 50, more preferably 2 to 20 amino acid residues. Examples include glutathione, calcitonin, vasopressin, oxytocin, and phytochelatin. A tin alloy plating solution with high serial stability can be derived by incorporating peptides with cysteine residues in tin alloy plating solution. While there is no theoretical restriction, complexes with noble metal ions such as silver ions can be formed in plating solution due to the strong nucleophilicity of thiol groups in peptides with cysteine residues. Metal ions can stably exist in a bath since the depositional potential of the complex in question is close to that of tin ions, and fixed codeposition ratios can be maintained.

Glutathione is especially preferable even among peptides with cysteine residues. Glutathione is a tripeptide that is peptide bound sequentially to glutamic acid, cysteine and glycine, and it has the following structural formula.

Formula 2

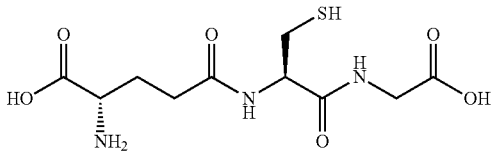

In addition to aforementioned reduced glutathione (abbreviated GSH), the oxidized type (abbreviated GSSG) represented by the following structural formula in which thiols of glutathione are linked by disulfide bonds is also present.

Formula 3

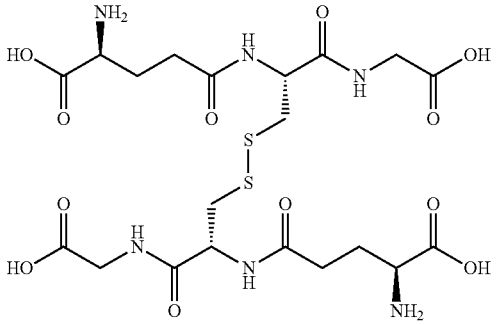

Oxidized glutathione forms reduced glutathione under neutral or acidic conditions. Thus, by using aforementioned oxidized glutathione (GSSG) in a neutral or acidic plating solution in the present invention, it may be used as reduced glutathione (GSH) in plating solutions. Unless otherwise indicated in the specifications, use of the term "glutathione" refers to reduced glutathione.

The concentration of peptides with cysteine residues in plating solution varies with the type and amount of metal ions in the tin alloy plating solution that is used, but it would usually be in the range of 0.1 to 70 g/L, preferably the range of 0.2 to 20 g/L. For example, in the case of tin-silver alloy plating solution with a silver codeposition ratio in the range of 1 to 5%, a range of 0.1 to 50 g/L of peptides with cysteine residues would be used, more preferably a range of 1 to 15 g/L.

Peptides with cysteine residues used in the present invention are characterized by their demonstration of inhibition of rapid decomposition of the bath even when used at equimolar levels to silver ions. For example, silver ions can be stabilized in baths by using twice the molar amounts or more of complexing agents of silver that are used in conventional tin-silver plating solutions to silver ions. However, the peptides with cysteine residues used in the present invention can stabilize silver ions in baths even at levels that are half the conventional levels. The desirable range of peptides with cysteine residues should be 0.3 to 1.8 times the moles of silver ions, more preferably 0.5 to 1.5 times the moles of silver ions.

The tin alloy plating solution pursuant to the present invention contains tin ions and one or more additional metal ions selected from the group consisting of silver, copper, bismuth, indium, palladium, lead, zinc, and nickel. The tin alloy plating solution may be an alloy plating solution comprising arbitrary combinations of tin ions with aforementioned one or more other metal ions. Plating solution comprising two metals or plating solutions comprising three or more metals are also permissible. Desirable examples of alloy plating solutions comprising two metals include tin-silver alloy plating solution, tin-copper alloy plating solution, and tin-bismuth alloy plating solution. Desirable examples of plating solutions comprising three or more constituents include tin-silver-copper alloy plating solution, tin-silver-palladium alloy plating solution, tin-silver-bismuth alloy plating solution, tin-zinc-bismuth alloy plating solution, and tin-silver-indium alloy plating solution. Among these, the use of tin-silver alloy plating solution, tin-silver-copper alloy plating solution, and tin-silver-bismuth alloy plating solution would be especially desirable.

Tin ions are derived by adding tin compounds to plating solution that form tin ions in plating solution. Examples of tin compounds include salts of tin with inorganic acids or organic acids, oxides of tin as well as halides of tin. Especially desirable concrete examples would include tin sulfate, tin nitrate, stannous oxide, stannous methanesulfonate, stannous oxide, stannous fluoroborate, and stannous 2-propanol sulfonate. Among these as well, tin sulfate, stannous methanesulfonate, and stannous 2-propanol sulfonate would be especially desirable.

Metal ions other than tin that form tin alloy plating solution are derived by adding to plating solutions those metal compounds that form metal ions in plating solution similarly to tin ions. For example, when the metal ions other than tin are silver ions, silver oxide, silver sulfate, silver chloride, silver nitrate, or silver methanesulfonate would be permissible silver compounds. Among these as well, silver methanesulfonate would be especially desirable. Permissible copper compounds include cupric sulfate, cupric oxide, and copper methanesulfonate. Among these as well, cupric sulfate would be especially desirable.

Known compounds can be used as sources of other metal ions. Examples include bismuth nitrate, bismuth sulfate, indium sulfate, zinc sulfate, palladium sulfate, barium acetate, bismuth methanesulfonate, and barium chloride.

There is no specific limitation on the concentrations of tin and of other metal ions in the plating solution, but the usual range would be 5 to 100 g/L of tin and 0.05 to 6 g/L of other metal ions. For example, when using tin-silver alloy plating solution, the desirable ranges would be 5 to 100 g/L of tin and 0.05 to 5/L of silver. A range of 20 to 80 g/L of tin and 0.1 to 3.5 g/L of silver would be still more desirable. When using a tin-silver-copper plating solution, the desirable ranges would be 5 to 100 g/L of tin, 0.05 to 5 g/L of silver and 0.1 to 1 g/L of copper. A still more desirable range would be 20 to 80 g/L of tin, 0.1 to 3.5 g/L of silver, and 0.15 to 0.35 g/L of copper.

The plating bath pursuant to the present invention would preferably be an acidic bath. Thiols in the peptides with cysteine residues would readily form disulfide bonds if the bath is neutral or alkaline. For example, if the peptides with cysteine residues are glutathione, oxidized glutathione would form in neutral or alkaline conditions and the effects of the present invention would be difficult to demonstrate. The pH of the plating bath preferably would be not more than 4, and more preferably not more than 1.

The tin alloy plating solution pursuant to the present invention may contain acid. Acid would render the plating solution acidic and would also act as an electroconductive compound. The acid may be organic acid or inorganic acid. Permissible organic acids include alkane sulfonic acids such as methane sulfonic acid and ethane sulfonic acid; hydroxy alkane sulfonic acids such as hydroxy propyl sulfonic acid; alkanol sulfonic acid such as isopropanol sulfonic acid; benzene sulfonic acid and phenol sulfonic acid. Inorganic acids include sulfuric acid, hydrochloric acid, and nitric acid.

The concentration of acid varies with the constituents of the target tin alloy plating solution, but it would preferably be in the range of 1 to 300 g/L, more preferably a range of 10 to 200 g/L in the case of an acidic tin-silver alloy plating solution.

The tin alloy plating solution pursuant to the present invention may contain surfactants. Various types of surfactants, including nonionic, anionic, cationic and amphoteric surfactants may be used as needed. The concentration of surfactants in the plating solution preferably would be in the range of 0.05 to 25 g/L, more preferably 0.1 to 10 g/L.

Concrete examples of nonionic surfactants include 2 to 300 molar addition condensation products of ethylene oxide (EO) and/or propylene oxide (PO) in $C_1$ to $C_{20}$ alkanols, phenols, naphthols, bisphenols, $C_1$ to $C_{25}$ alkyl phenols, aryl alkyl phenols, $C_1$ to $C_{25}$ alkyl naphthols, $C_1$ to $C_{25}$ alkoxylated phosphoric acid (salts), sorbitan esters, styrenated phenols, polyalkylene glycol, $C_1$ to $C_{22}$ aliphatic amines, $C_1$ to $C_{22}$ aliphatic amides as well as $C_1$ to $C_{25}$ alkoxylated phosphoric acid (salts) and the like.

Permissible examples of $C_1$ to $C_{20}$ alkanols with addition condensation of ethylene oxide (EO) and/or propylene oxide (PO) include octanol, decanol, lauryl alcohol, tetradecanol, hexadecanol, stearyl alcohol, eicosanol, cetyl alcohol, oleyl alcohol, and docosanol. Permissible examples of bisphenols include bisphenol A, bisphenol B, and bisphenol F. Permissible examples of $C_1$ to $C_{25}$ alkyl phenols include mono-, di-, or trialkyl substituted phenols such as p-methyl phenol, p-butyl phenol, p-isooctyl phenol, p-nonyl phenol, p-hexyl phenol, 2,4-dibutyl phenol, 2,4,6-tributyl phenol, dinonyl phenol, p-dodecyl phenol, p-lauryl phenol, and p-stearyl phenol. Permissible examples of aryl alkyl phenols include 2-phenyl isopropyl phenol and cumyl phenol. In addition, permissible examples of alkyls of $C_1$ to $C_{25}$ alkyl napthol include methyl, ethyl, propyl, butylhexyl, octyl, decyl, dodecyl, and octadecyl.

Permissible examples of sorbitan esters include di- or tri-esterified 1,4-, 1,5- or 3,6-sorbitans typified by sorbitan monolaurate, sorbitan monopalmitate, sorbitan distearate, sorbitan dioleate, and sorbitan mixed fatty acid esters. $C_1$ to $C_{22}$ aliphatic amines include saturated or unsaturated fatty acid amines such as propyl amine, butyl amine, hexyl amine, octyl amine, decyl amine, lauryl amine, myristyl amine, stearyl amine, oleyl amine, tallow amine, ethylene diamine, and propylene diamine Permissible examples of $C_1$ to $C_{22}$ aliphatic amides include amides of propionic acid, butyric acid, caprylic acid, capric acid, lauric acid, myristic acid, palmitic acid, stearic acid, oleic acid, behenic acid, coconut oil fatty acid, and of tallow fatty acid.

Amine oxides may be used as nonionic surfactants. Mixtures of two or more nonionic surfactants may be used as well. The concentration of nonionic surfactants in plating solution should be in the range of 0.05 to 25 g/L, preferably a range of 0.1 to 10 g/L.

Cationic surfactants include quaternary ammonium salts and pyridium salts. Concrete examples include lauryl trimethyl ammonium salt, stearyl trimethyl ammonium salt, lauryl dimethylethyl ammonium salt, octadecyl dimethylethyl ammonium salt, dimethylbenzyl lauryl ammonium salt, cetyl dimethylbenzyl ammonium salt, octadecyl dimethylbenzyl ammonium salt, trimethylbenzyl ammonium salt, triethylbenzyl ammonium salt, hexadecyl pyridium salt, lauryl pyridium salt, dodecyl pyridium salt, stearyl amine acetate, lauryl amine acetate, and octadecyl amine acetate.

Anionic surfactants include alkyl sulfates, polyoxyethylene alkyl ether sulfates, polyoxyethylene alkyl phenyl ether sulfates, alkyl benzene sulfonates, and (mono, di, tri) alkylnaphthalene sulfonates. Permissible examples of alkyl sulfates include sodium lauryl sulfate and sodium oleyl sulfate. Permissible examples of polyoxyethylene alkyl ether sulfates include polyoxyethylene (EO12) sodium nonyl ether sulfate and polyoxyethylene (EO15) sodium dodecyl ether sulfate. Polyoxyethylene alkyl phenyl ether sulfates include polyoxyethylene (EO15) nonyl phenyl ether sulfate. Alkyl benzene sulfonates include sodium dodecylbenzene sulfonate. In addition, (mono, di, tri) alkylnaphthalene sulfonates include sodium dibutylnaphthalene sulfonate.

Surfactants include carboxybentaine, imidazoline betaine, sulfobetaine and aminocarboxylic acid. Sulfated or sulfonated adducts of condensation products of ethylene oxide and/or propylene oxide with alkyl amines or diamines may also be used.

Typical carboxybetaines and imidazolinebetaines include lauryl dimethyl amino acetic acid betaine, myristyl dimethyl amino acetic acid betaine, stearyl dimethyl amino acetic acid betaine, coconut oil fatty acid amido propyl dimethyl amino acetic acid betaine, 2-undecyl-1-carboxymethyl-1-hydroxyethyl imidazolinium betaine, and 2-octyl-1-carboxymethyl-1-carboxyethyl imidazolinium betaine. Sulfated and sulfonated adducts include sulfuric acid adducts of ethoxylated alkyl amines and sodium salts of sulfonated lauryl acid derivatives.

Sulfobentaines include coconut oil fatty acid amido propyl dimethyl ammonium-2-hydroxypropane sulfonic acid, sodium N-methyl cocoyl taurate and sodium N-methyl palmitoyl taurate. Aminocarboxylic acids include octyl amino ethyl glycine, N-lauryl aminopropionic acid, and octyl di (aminoethyl) glycine sodium salts.

The tin alloy plating solution pursuant to the present invention may include additives that are commonly used in plating solutions as required, include antioxidants, gloss agents, polishing agents, pH regulators, crystal refining agents (grain refiners), or accessory complexing agents.

The solvent used in the tin alloy plating solution pursuant to the present invention preferably would be water, but water containing alcohols such as methanol or ethanol as well as organic solvents such as acetone may be used.

A tin alloy plating precipitate can be formed on an electroconductive object using the tin alloy plating bath pursuant to the present invention. The electroconductive object would be an object with material that is electroconductive on at least part of the surface. Concrete examples of electroconductive objects include electronic components such as chips, plastics with electroconductive material on the surface, printed wiring harness boards, semiconductor wafers, quartz oscillators, lead lines, and modules. Furthermore, electroconductive materials include copper, copper alloys, nickel, nickel alloys, and nickel iron.

The method of precipitating tin alloy plating on an electroconductive object using the tin alloy plating solution pursuant to the present invention contains two steps; step (A) in which an electroconductive object is brought into contact with a tin alloy plating solution containing tin ions and one or more additional metal ions selected from the group consisting of silver, copper, bismuth, indium, palladium, lead, zinc, and nickel, as well as peptides with cysteine residues, and step (B) in which current is passed between electrodes and said electroconductive object.

The temperature of the tin alloy plating solution preferably would be in the range of 10 to 50° C., more preferably 15 to 35° C. In addition, the current used in plating may be direct current or pulse current. The current density preferably would be in the range of 0.5 to 10 A/dm$^2$, more preferably the range of 1 to 8 A/dm$^2$.

In addition, any of a variety of high-speed plating methods may be used, including horizontal plating, vertical plating, parallel plating, rack plating, or jet plating.

Examples of the present invention are explained below, but the present invention is not restricted to these embodiments.

EXAMPLE 1

A tin-silver alloy plating solution with the following composition was prepared.

Composition of Plating Solution stannous methanesulfonate (source of tin ions) 20 g/L silver methanesulfonate (source of silver ions) 0.5 g/L methanesulfonic acid (70% aqueous solution) 40 ml/L nonionic surfactant (brand name "Pegnol D-210Y", polyoxyethylene polyoxypropylene alkyl ether, product of Toa Chemical K.K.), 0.5 g/L glutathione 1.4 g/L catechol 2 g/L remainder; deionized water Stability Test of Plating Bath Preparation of the plating solution was followed by storage at room temperature. It was observed macroscopically every 24 hours for the development of turbidity or precipitation. In addition, the day of development of turbidity or precipitation was recorded.

Test specimens (2 cm×3 cm size copper lined glass epoxy plate (Hitachi Chemical Co., Ltd.: MCL-E67)) were immersed in 7% methansulfonic acid solution for one minute, followed by washing with water for one minute Immediately after preparation, they were immersed in aforementioned plating solution. Using an insoluble platinum electrode as the positive pole, the time was adjusted so that the total amount of electricity would reach 90 C at each current density of 1, 2, 6 and 8 A/dm$^2$. Electroplating was then conducted at a bath temperature of 25° C. The test specimen was washed with water following plating and the surface of the plated film was macroscopically observed after drying.

The co-deposition ratios of tin and silver were measured in the following manner The test specimens were immersed for 3 minutes in 10 mL of a 40% nitric acid aqueous solution at room temperature and then withdrawn, followed by the addition of deionized water until 50 mL was reached for dilution. The concentrations of tin and of silver were measured using an atomic absorption analyzer (Shimadzu AA-6800, product of Shimadzu Works), and the ratios were calculated. Table 1 presents the results.

COMPARATIVE EXAMPLE 1

Plating solution was prepared similarly to that in Example 1 except for the exclusion of glutathione.

COMPARATIVE EXAMPLE 2

Plating solution was prepared similarly to that in Example 1 except for the use of 0.4 g/L of thiourea instead of glutathione.

COMPARATIVE EXAMPLE 3

Plating solution was prepared similarly to that in Example 1 except for the use of 0.85 g/L of 3,6-dithiaoctane-1,8-thiol instead of glutathione.

COMPARATIVE EXAMPLE 4

Plating solution was prepared similarly to that in Example 1 except for the use of 0.8 g/L of bis (2-hydroxyethyl) disulfide instead of glutathione.

COMPARATIVE EXAMPLE 5

Plating solution was prepared similarly to that in Example 1 except for the use of 0.8 g/L of mercaptosuccinic acid instead of glutathione.

COMPARATIVE EXAMPLE 6

Plating solution was prepared similarly to that in Example 1 except for the use of 0.6 g/L of dimethyl urea instead of glutathione.

COMPARATIVE EXAMPLE 7

Plating solution was prepared similarly to that in Example 1 except for the use of 0.6 g/L of cysteine instead of glutathione.

COMPARATIVE EXAMPLE 8

Plating solution was prepared similarly to that in Example 1 except for the use of 1 g/L of glycyl glutamine instead of glutathione.

COMPARATIVE EXAMPLE 9

Plating solution was prepared similarly to that in Example 1 except for the use of 1 g/L of glycyl glutamic acid instead of glutathione.

COMPARATIVE EXAMPLE 10

Plating solution was prepared similarly to that in Example 1 except for the use of 0.6 g/L of cysteine and 1 g/L of glycyl glutamine instead of glutathione.

COMPARATIVE EXAMPLE 11

Plating solution was prepared similarly to that in Example 1 except for the use of 0.6 g/L of cysteine and 1 g/L of glycyl glutamic acid instead of glutathione.

TABLE 1

| Examples | Bath stability | Current density (ASD) | Co-deposition ratio of silver (%) | Plating appearance |
|---|---|---|---|---|
| Example 1 | no decomposition even after 2 months | 1 | 2.5 | white/gray color, matt, smooth |
| | | 2 | 2.6 | white/gray color, matt, smooth |
| | | 6 | 3.0 | white/gray color, matt, smooth |
| | | 8 | 1.9 | white/gray color, matt, smooth |
| Comparative example 1 | decomposed immediately after bath preparation | 1 | — | — |
| | | 2 | — | — |
| | | 6 | — | — |
| | | 8 | — | — |
| Comparative | decomposed | 1 | 2.0 | dark gray, |

TABLE 1-continued

| Examples | Bath stability | Current density (ASD) | Co-deposition ratio of silver (%) | Plating appearance |
|---|---|---|---|---|
| example 2 | after 1 week | | | not smooth |
| | | 2 | 4.8 | dark gray, not smooth |
| | | 6 | 4.9 | scorched |
| | | 8 | 3.5 | scorched |
| Comparative example 3 | decomposed after 1 week | 1 | 0.16 | white/gray color, matt |
| | | 2 | 0.26 | dark white/ gray color, not smooth |
| | | 6 | 0.43 | scorched |
| | | 8 | 0.45 | scorched |
| Comparative example 4 | decomposed after 2 days | 1 | — | — |
| | | 2 | — | — |
| | | 6 | — | — |
| | | 8 | — | — |
| Comparative example 5 | decomposed immediately after bath preparation | 1 | — | — |
| | | 2 | — | — |
| | | 6 | — | — |
| | | 8 | — | — |
| Comparative example 6 | decomposed immediately after bath preparation | 1 | — | — |
| | | 2 | — | — |
| | | 6 | — | — |
| | | 8 | — | — |
| Comparative example 7 | decomposed after 3 days | 1 | — | — |
| | | 2 | — | — |
| | | 6 | — | — |
| | | 8 | — | — |
| Comparative example 8 | decomposed immediately after bath preparation | 1 | — | — |
| | | 2 | — | — |
| | | 6 | — | — |
| | | 8 | — | — |
| Comparative example 9 | decomposed immediately after bath preparation | 1 | — | — |
| | | 2 | — | — |
| | | 6 | — | — |
| | | 8 | — | — |
| Comparative example 10 | decomposed after 6 days | 1 | 1.2 | dark gray, not smooth |
| | | 2 | 0.88 | dark gray, not smooth |
| | | 6 | 1.1 | scorched |
| | | 8 | 1.3 | scorched |
| Comparative example 11 | decomposed after 4 days | 1 | 1.3 | dark gray, not smooth |
| | | 2 | 0.89 | dark gray, not smooth |
| | | 6 | 1.1 | scorched |
| | | 8 | 1.3 | scorched |

The bath containing peptides with cysteine residues (GSH) (Embodiment 1) had high bath stability and underwent little change in the silver precipitation rate accompanying change in the current density. In contrast, baths using the conventional complexing agent (Comparative Examples 1 to 6) had low bath stability, and all decomposed within one week (black turbidity or precipitation). In addition, the bath stability was low and the effects of the present invention were not realized in the bath that used cysteine alone (Comparative Example 7) instead of peptides with cysteine residues, the baths that used amino acid peptides without cysteine residues (Comparative Examples 8, 9), and the baths that used mixtures of these (Comparative Examples 10, 11).

EXAMPLES 2 and 3

Bath Stability Tests

Plating solution was prepared similarly to that in Example 1 except for altering the amount of glutathione to 0.7 g/L and 2.1 g/L of glutathione. Stability tests were conducted on the plating solutions that were prepared, and bath decomposition was confirmed after two weeks in Example 2. In Example 3, white precipitate developed in the bath after one month. This white precipitate was believed to be due to the interaction of glutathione and catechol that had been added to the plating solution.

What is claimed is:

1. A tin alloy plating solution consisting of tin ions, silver ions, metal ions selected from the group consisting of copper ions and bismuth ions, an organic acid or an inorganic acid, optionally one or more additives selected from the group consisting of complexing agents, grain refiners, antioxidants, gloss agents, pH regulators, organic solvents and surfactants, water and peptides with cysteine residues, wherein a range of peptides with cysteine residues are 0.3 to 1.8 times the moles of silver ions.

2. The tin alloy plating solution of claim 1 wherein the peptides with cysteine residues have 2 to 20 amino acid residues.

3. The tin alloy plating solution of claim 1 wherein the peptide with cysteine residues is glutathione.

4. The tin alloy plating solution of claim 1 wherein the plating solution has a pH of not more than 4.

5. A method of depositing tin alloy plating onto an electroconductive object comprising: step (A) contacting an electroconductive object with the tin alloy plating solution of claim 1; and step (B) passing a current between electrodes and the electroconductive object to plate the electroconductive object with the tin alloy.

* * * * *